US011063349B2

(12) United States Patent
Lo et al.

(10) Patent No.: US 11,063,349 B2
(45) Date of Patent: Jul. 13, 2021

(54) MOBILE DEVICE

(71) Applicant: Quanta Computer Inc., Taoyuan (TW)

(72) Inventors: Wen-Yuan Lo, Taoyuan (TW); Jui-Chun Jao, Taoyuan (TW); Kuo-Jung Tseng, Taoyuan (TW)

(73) Assignee: QUANTA COMPUTER INC., Taoyuan (TW)

( * ) Notice: Subject to any disclaimer, the term of this patent is extended or adjusted under 35 U.S.C. 154(b) by 0 days.

(21) Appl. No.: 16/410,177

(22) Filed: May 13, 2019

(65) Prior Publication Data

US 2020/0243962 A1 Jul. 30, 2020

(30) Foreign Application Priority Data

Jan. 24, 2019 (TW) ..... 108102627 A

(51) Int. Cl.

| | |
|---|---|
| ***H01Q 1/22*** | (2006.01) |
| ***H01Q 1/48*** | (2006.01) |
| ***H01Q 5/10*** | (2015.01) |
| *H01Q 1/12* | (2006.01) |
| *H01Q 1/24* | (2006.01) |

(52) U.S. Cl.

CPC ..... *H01Q 1/48* (2013.01); *H01Q 1/2266* (2013.01); *H01Q 5/10* (2015.01); *H01Q 1/12* (2013.01); *H01Q 1/125* (2013.01); *H01Q 1/22* (2013.01); *H01Q 1/2283* (2013.01); *H01Q 1/243* (2013.01)

(58) Field of Classification Search

CPC ..... H01Q 1/12; H01Q 1/125; H01Q 1/22; H01Q 1/2283; H01Q 1/243

See application file for complete search history.

(56) References Cited

U.S. PATENT DOCUMENTS

| | | | | |
|---|---|---|---|---|
| 9,590,304 | B2 * | 3/2017 | You | H01Q 1/243 |
| 9,680,212 | B2 * | 6/2017 | Konu | H01Q 1/48 |
| 9,680,223 | B2 * | 6/2017 | Wu | H01Q 1/243 |
| 10,069,196 | B1 * | 9/2018 | Yen | H01Q 1/243 |

(Continued)

FOREIGN PATENT DOCUMENTS

| | | |
|---|---|---|
| TW | M521272 U | 5/2016 |
| TW | 201843877 A | 12/2018 |

OTHER PUBLICATIONS

Chinese language office action dated Feb. 10, 2020, issued in application No. TW 108102627.

(Continued)

*Primary Examiner* — Thuy Vinh Tran

(74) *Attorney, Agent, or Firm* — McClure, Qualey & Rodack, LLP

(57) ABSTRACT

A mobile device includes a metal back cover, an edge appearance element, a display device, a supporting element, an antenna structure, and a ground element. The edge appearance element is made of a nonconductive material. The edge appearance element is connected to the metal back cover. The display device is disposed opposite to the metal back cover. The antenna structure is disposed on the supporting element. The antenna structure is positioned between the edge appearance element and the display device. The ground element is coupled to the metal back cover. The electromagnetic waves of the antenna structure are transmitted through the edge appearance element, such that the mobile device supports wireless communication.

9 Claims, 5 Drawing Sheets

(56) References Cited

U.S. PATENT DOCUMENTS

| | | | | |
|---|---|---|---|---|
| 10,439,269 | B2 | 10/2019 | Wei et al. | |
| 10,559,882 | B2 * | 2/2020 | Lee | H01Q 9/42 |
| 2015/0061952 | A1 * | 3/2015 | Chiang | H01Q 5/371 343/749 |
| 2017/0005414 | A1 * | 1/2017 | Yang | H01Q 5/378 |
| 2017/0346161 | A1 * | 11/2017 | Wu | H01Q 1/241 |

OTHER PUBLICATIONS

Chinese language office action dated May 28, 2020, issued in application No. TW 108102627.

* cited by examiner

MOBILE DEVICE

CROSS REFERENCE TO RELATED APPLICATIONS

This application claims priority of Taiwan Patent Application No. 108102627 filed on Jan. 24, 2019, the entirety of which is incorporated by reference herein.

BACKGROUND OF THE INVENTION

Field of the Invention

The disclosure generally relates to a mobile device, and more particularly, it relates to a mobile device and an antenna structure therein.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

In order to improve their appearance, designers often incorporate metal elements into mobile devices. However, these newly added metal elements tend to negatively affect the antennas used for wireless communication in mobile devices, thereby degrading the overall communication quality of the mobile devices. As a result, there is a need to propose a mobile device with a novel antenna structure, so as to overcome the problems of the prior art.

BRIEF SUMMARY OF THE INVENTION

In an exemplary embodiment, the disclosure is directed to a mobile device including a metal back cover, an edge appearance element, a display device, a supporting element, an antenna structure, and a ground element. The edge appearance element is made of a nonconductive material. The edge appearance element is connected to the metal back cover. The display device is disposed opposite to the metal back cover. The antenna structure is disposed on the supporting element. The antenna structure is positioned between the edge appearance element and the display device. The ground element is coupled to the metal back cover. The electromagnetic waves of the antenna structure are transmitted through the edge appearance element, such that the mobile device supports wireless communication.

In some embodiments, the metal back cover is a complete metal plane without any slot.

In some embodiments, the ground element is a ground copper foil extending from the metal back cover onto the supporting element.

In some embodiments, the distance between the supporting element and the display device is longer than 1 mm.

In some embodiments, the antenna structure covers a first frequency band from 2400 MHz to 2500 MHz, and a second frequency band from 5150 MHz to 5850 MHz.

In some embodiments, the antenna structure includes a feeding radiation element, a connection element, a first radiation element, a second radiation element, a third radiation element, and a shorting element. The feeding radiation element has a feeding point. The connection element is coupled to the feeding radiation element. The first radiation element is coupled to the connection element. The first radiation element extends toward the ground element. The connection element is coupled through the shorting element to the ground element. The second radiation element is coupled to the connection element. The third radiation element is coupled to the shorting element. The second radiation element and the third radiation element extend in the same direction.

In some embodiments, the shorting element further includes a rectangular widening portion coupled to the ground element.

In some embodiments, the antenna structure further includes a fourth radiation element coupled to the feeding radiation element. The fourth radiation element and the second radiation element extend in opposite directions.

In some embodiments, the mobile device further includes a coaxial cable. The coaxial cable includes a central conductive line and a conductive housing. The central conductive line is coupled to the feeding point. The conductive housing is coupled to the ground element.

In some embodiments, the length of the coaxial cable is shorter than 720 mm.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
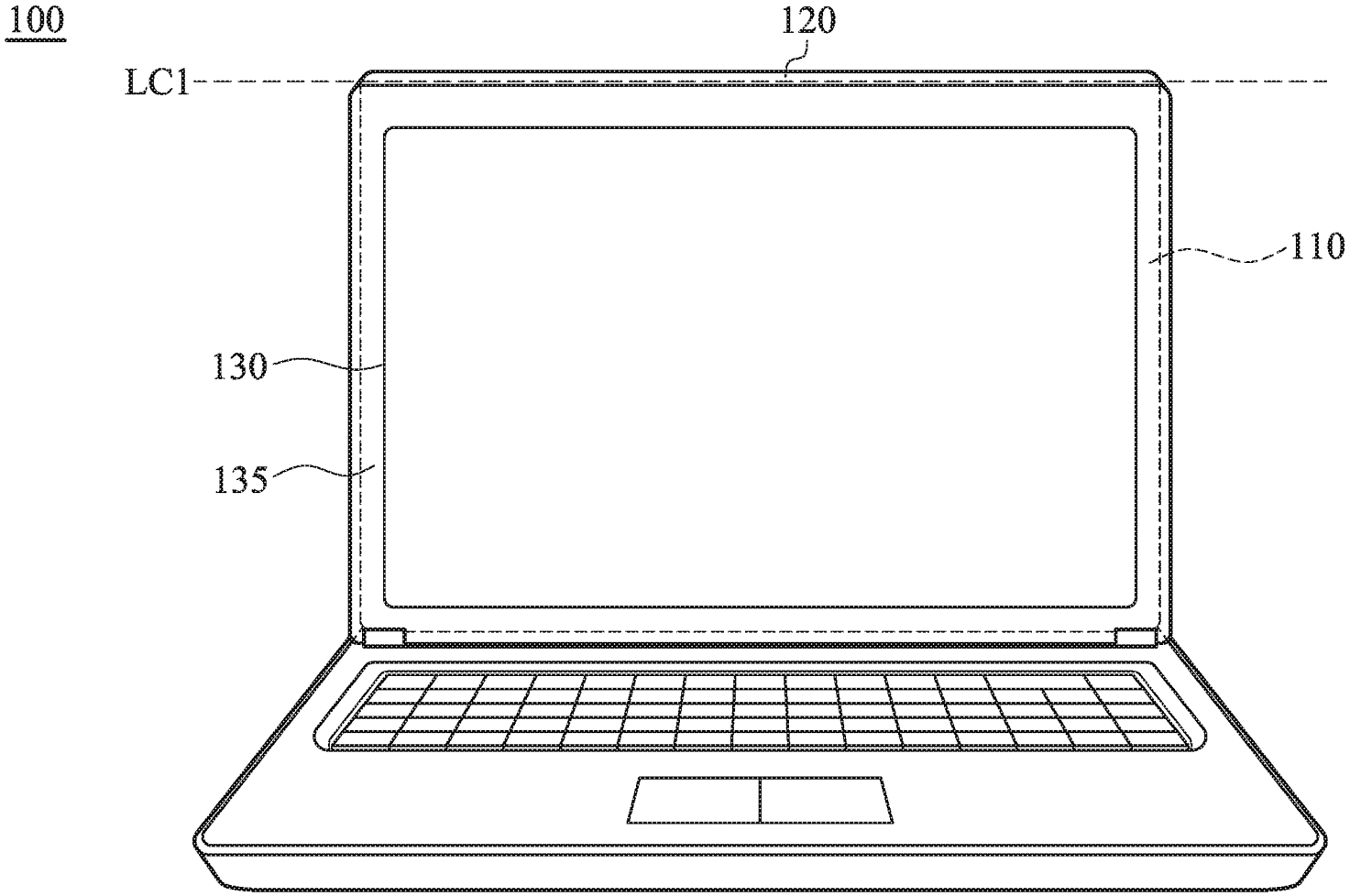
FIG. 1A is a perspective view of a mobile device according to an embodiment of the invention.
Figure 1B:
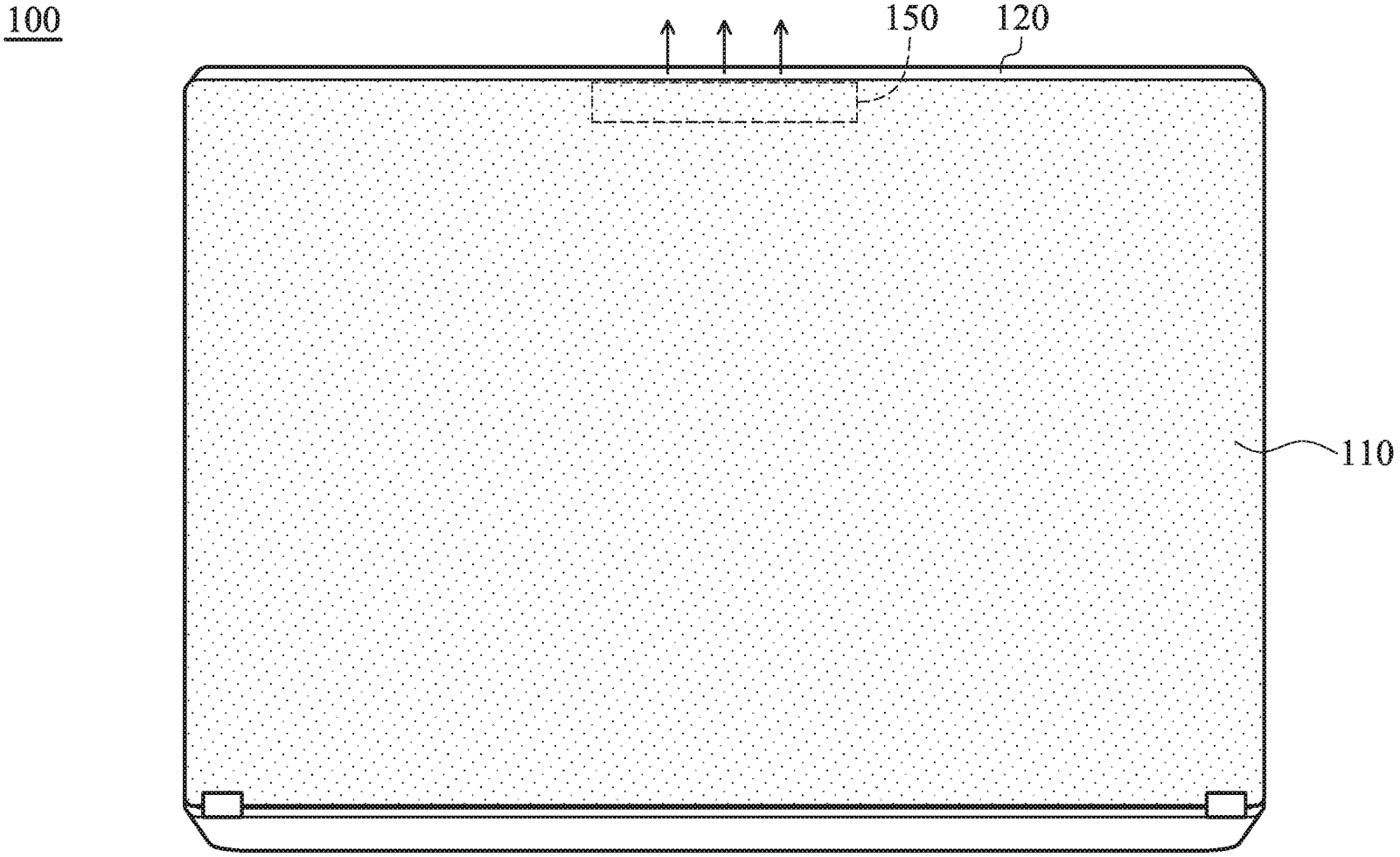
FIG. 1B is a back view of a mobile device according to an embodiment of the invention.
Figure 1C:
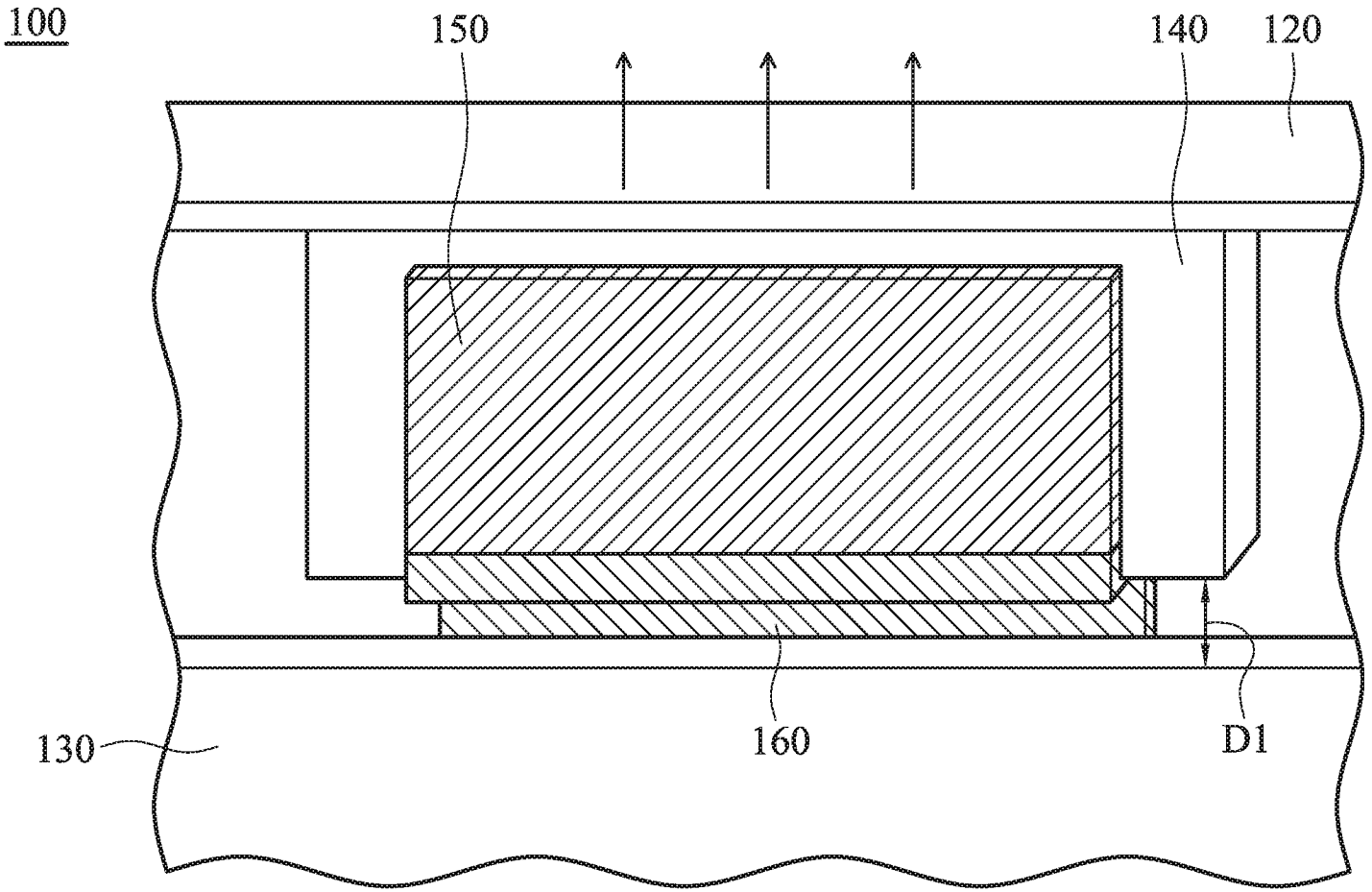
FIG. 1C is a sectional view of a mobile device according to an embodiment of the invention.

FIG. 1A is a perspective view of a mobile device 100 according to an embodiment of the invention. FIG. 1B is a back view of the mobile device 100 according to an embodiment of the invention. FIG. 1C is a sectional view of the mobile device 100 according to an embodiment of the invention (along a sectional line LC1 of FIG. 1A). Please refer to FIG. 1A, FIG. 1B and FIG. 1C together. In the embodiment of FIG. 1A, FIG. 1B and FIG. 1C, the mobile device 100 is a notebook computer, but the invention is not limited thereto. In alternative embodiments, the mobile device 100 is a smartphone or a tablet computer.

As shown in FIG. 1A, FIG. 1B and FIG. 1C, the mobile device 100 at least includes a metal back cover 110, an edge appearance element 120, a display device 130, a supporting element 140, an antenna structure 150, and a ground element 160. The edge appearance element 120 and the supporting element 140 may be made of nonconductive materials, such as plastic materials. The antenna structure 150 and the ground element 160 may be made of conductive materials, such as metal materials.

The metal back cover 110 is a complete metal plane which includes neither any slot nor any slit. The metal back cover 110 may be considered as an "A-component" in the field of notebook computers. The edge appearance element 120 is connected to the metal back cover 110. In some embodiments, the edge appearance element 120 is a long and narrow sidewall connected between the metal back cover 110 and a display frame 135. The display frame 135 may be considered as a "B-component" in the field of notebook computers. The so-called "appearance element" over the disclosure means a portion which eyes of a user can directly observe. The display device 130 is disposed opposite to the metal back cover 110. The display device 130 may be embedded in the display frame 135. The supporting element 140 is disposed adjacent to the metal back cover 110. The supporting element 140 is positioned between the edge appearance element 120 and the display device 130. It should be noted that the term "adjacent" or "close" over the disclosure means that the distance (spacing) between two corresponding elements is smaller than a predetermined distance (e.g., 5 mm or shorter), or means that the two corresponding elements directly touch each other (i.e., the aforementioned distance/spacing therebetween is reduced to 0). In some embodiments, the supporting element 140 includes a holder and an FPC (Flexible Circuit Board).

The antenna structure 150 is disposed on the supporting element 140. The antenna structure 150 is also positioned between the edge appearance element 120 and the display device 130. It should be noted that the type of the antenna structure 150 is not limited in the invention. For example, the antenna structure 150 may be a monopole antenna, a dipole antenna, a patch antenna, a helical antenna, a PIFA (Planar Inverted F Antenna), or a chip antenna. The ground element 160 may be coupled to the metal back cover 110 by using LDS (Laser Direct Structuring) technology. For example, the ground element 160 may be a ground copper foil extending from the metal back cover 110 onto the supporting element 140.

In a preferred embodiment, the electromagnetic waves of the antenna structure 150 are transmitted through the edge appearance element 120 (as the directions of the arrows in the figure), such that the mobile device 100 can support the function of wireless communication. Since the edge appearance element 120 is not made of a conductive material, it does not interfere with the radiation pattern of the antenna structure 150. With such a design, the metal back cover 110 maintains its complete shape and does not have any opening, thereby improving the visual appearance of the mobile device 100.

The following embodiments will introduce the detailed features of the antenna structure 150. It should be understood that these figures and descriptions are merely exemplary, rather than limitations of the invention.

Figure 2:
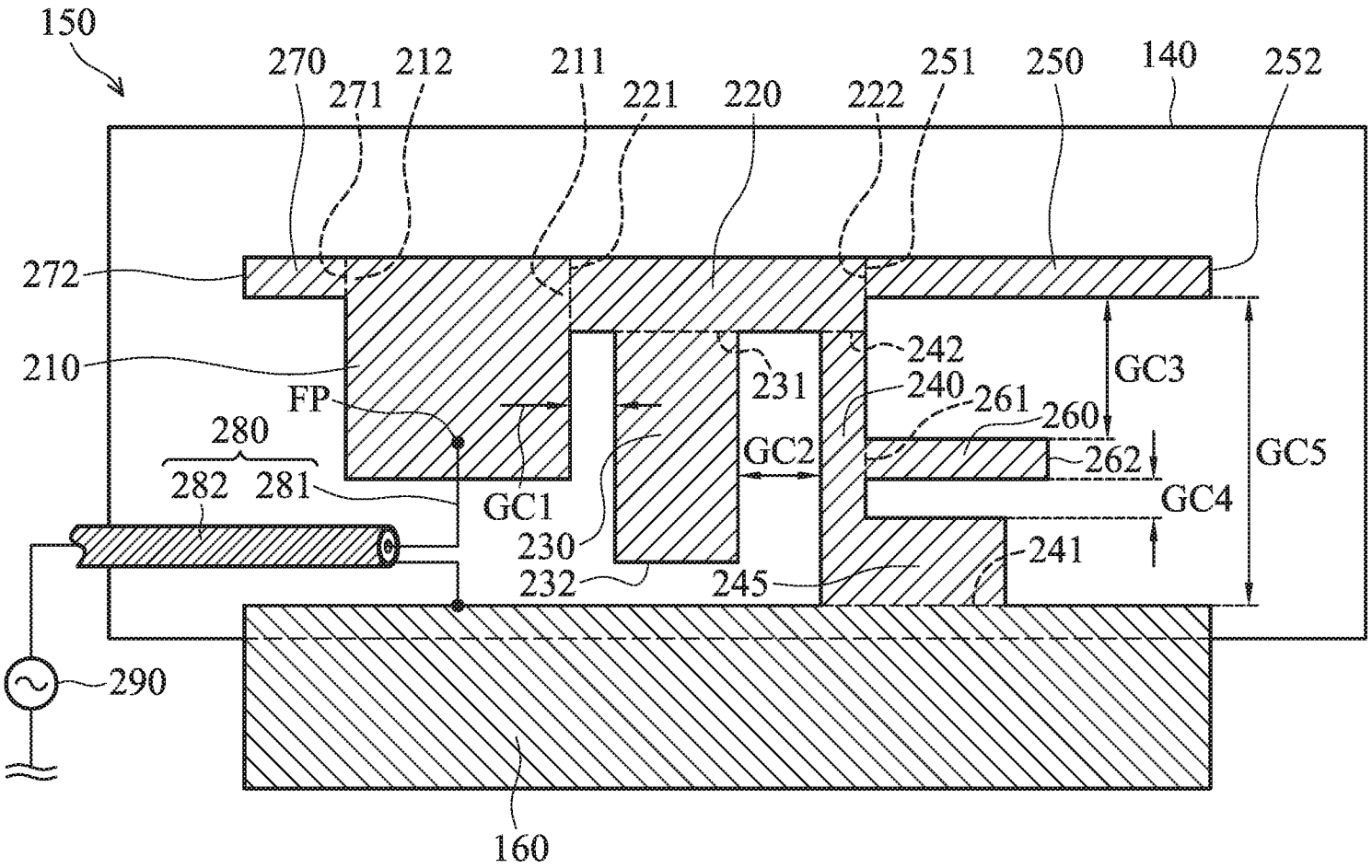
FIG. 2 is a top view of an antenna structure according to an embodiment of the invention.

FIG. 2 is a top view of the antenna structure 150 according to an embodiment of the invention. In the embodiment of FIG. 2, the antenna structure 150 at least includes a feeding radiation element 210, a connection element 220, a first radiation element 230, a shorting element 240, a second radiation element 250, and a third radiation element 260. The feeding radiation element 210 may substantially have a rectangular shape or a square shape. The feeding radiation element 210 has a feeding point FP, which may be coupled to a signal source 290, such as an RF (Radio Frequency) module. The connection element 220 may substantially have a straight-line shape. The connection element 220 has a first end 221 and a second end 222. The first end 221 of the connection element 220 is coupled to a first corner 211 of the feeding radiation element 210. The first radiation element 230 may substantially have a rectangular shape or a straight-line shape. The first radiation element 230 has a first end 231 and a second end 232. The first end 231 of the first radiation element 230 is coupled to a median portion of the connection element 220. The second end 232 of the first radiation element 230 is an open end, which extends toward the ground element 160. The shorting element 240 may substantially have a straight-line shape or an L-shape. The shorting element 240 has a first end 241 and a second end 242. The first end 241 of the shorting element 240 is coupled to the ground element 160. The second end 242 of the shorting element 240 is coupled to the second end 222 of the connection element 220. Thus, the connection element 240 is coupled through the shorting element 240 to the ground element 160. The second radiation element 250 may substantially have a straight-line shape. The second radiation element 250 has a first end 251 and a second end 252. The first end 251 of the second radiation element 250 is coupled to the second end 222 of the connection element 220. The second end 252 of the second radiation element 250 is an open end. The third radiation element 260 may substantially have a straight-line shape, which may be substantially parallel to the second radiation element 250. The third radiation element 260 has a first end 261 and a second end 262. The first end 261 of the third radiation element 260 is coupled to a median portion of the shorting element 240. The second end 262 of the third radiation element 260 is an open end. The second end 252 of the second radiation element 250 and the second end 262 of the third radiation element 260 may substantially extend toward the same direction.

Figure 3:
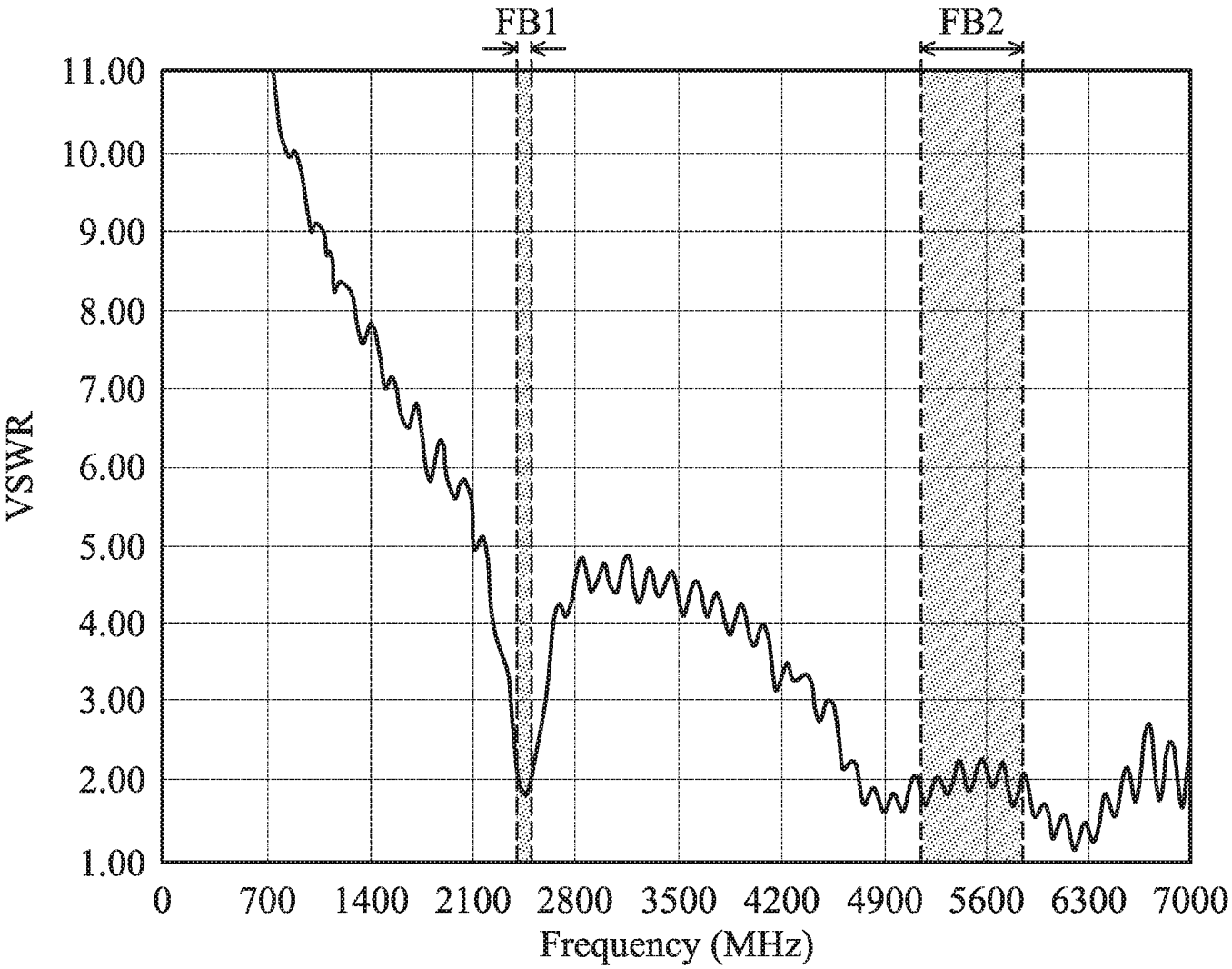
FIG. 3 is a diagram of VSWR (Voltage Standing Wave Ratio) of an antenna structure of a mobile device according to an embodiment of the invention.

FIG. 3 is a diagram of VSWR (Voltage Standing Wave Ratio) of the antenna structure 150 of the mobile device 100 according to an embodiment of the invention. The horizontal axis represents the operation frequency (MHz), and the vertical axis represents the VSWR. According to the measurement of FIG. 3, the antenna structure 150 can cover a first frequency band FB1 and a second frequency band FB2. The first frequency band FB1 may be from 2400 MHz to 2500 MHz. The second frequency band FB2 may be from 5150 MHz to 5850 MHz. Therefore, the antenna structure 150 can support at least the dual-band operations of WLAN (Wireless Local Area Networks) 2.4 GHz/5 GHz. With respect to the operation principles of the antenna structure 150, the feeding radiation element 210, the connection element 220, the first radiation element 230, and the second radiation element 250 are mainly excited to generate the aforementioned first frequency band FB1; the shorting element 240 and the third radiation element 260 are mainly excited to generate the aforementioned second frequency band FB2. According to practical measurement, the radiation efficiency of the antenna structure 150 is about −4.69 dB within the first frequency band FB1, and the radiation efficiency of the antenna structure 150 is about −4.96 dB within the second frequency band FB2. It can meet the requirements of practical applications of general mobile communication devices.

In some embodiments, the shorting element 240 further includes a rectangular widening portion 245, which is positioned at the first end 241 of the shorting element 240 and is directly coupled to the ground element 160. According to practical measurement, the rectangular widening portion 245 of the shorting element 240 is configured to increase the operation bandwidth of the antenna structure 150. In some embodiments, the antenna structure 150 further includes a fourth radiation element 270. The fourth radiation element 270 may substantially have a straight-line shape. The fourth radiation element 270 has a first end 271 and a second end 272. The first end 271 of the fourth radiation element 270 is coupled to a second corner 212 of the feeding radiation element 210 (the second corner 212 is opposite to the first corner 211). The second end 272 of the fourth radiation element 270 and the second end 252 of the second radiation element 250 may substantially extend in opposite directions. According to practical measurement, the fourth radiation element 270 is configured to fine-tune the impedance matching of the antenna structure 150. In some embodiments, the mobile device 100 includes a coaxial cable 280. The coaxial cable 280 includes a central conductive line 281 and a conductive housing 282. A positive electrode of the signal source 290 is coupled through the central conductive line 281 to the feeding point FP. A negative electrode of the signal source 290 is coupled through the conductive housing 282 to the ground element 160. According to practical measurement, if the length of the coaxial cable 280 is shorter than 720 mm, the antenna structure 150 will have relatively low transmission loss and relatively high antenna gain. It should be understood that the rectangular widening portion 245 of the shorting element 240, the fourth radiation element 270, and the coaxial cable 280 are optional elements, and they may be omitted in other embodiments.

In some embodiments, the element sizes of the mobile device 100 are as follows. The distance D1 between the supporting element 140 (or the antenna structure 150) and the display device 130 should be longer than 1 mm, so as to prevent the display device 130 from negatively affecting the radiation pattern of the antenna structure 150. A first coupling gap GC1 may be formed between the feeding radiation element 210 and the first radiation element 230. The width of the first coupling gap GC1 should be shorter than 2 mm. A second coupling gap GC2 may be formed between the first radiation element 230 and the shorting element 240. The width of the second coupling gap GC2 should be shorter than 3 mm. A third coupling gap GC3 may be formed between the second radiation element 250 and the third radiation element 260. The width of the third coupling gap GC3 should be shorter than 6 mm. A fourth coupling gap GC4 may be formed between the third radiation element 260 and the rectangular widening portion 245 of the shorting element 240. The width of the fourth coupling gap GC4 should be shorter than 1 mm. A fifth coupling gap GC5 may be formed between the second radiation element 250 and the ground element 160. The width of the fifth coupling gap GC5 should be shorter than 8 mm. The width ranges of the above coupling gaps are calculated and obtained according to many experiment results, and they help to enhance the coupling effect between the elements of the antenna structure 150, thereby increasing the whole antenna gain.

The invention proposes a novel antenna structure. When the antenna structure is applied to a mobile device including a metal back cover, it effectively prevents the metal back cover from negatively affecting the communication quality of the mobile device because the metal back cover is considered as an extension portion of the antenna structure. It should be also noted that the invention can improve the appearance and design of the mobile device, without opening any antenna windows on the metal back cover. The electromagnetic waves of the antenna structure can be transmitted through an edge appearance element of the mobile device. In conclusion, the invention has the advantages of small size, wide bandwidth, and beautiful device appearance, and therefore it is suitable for application in a variety of mobile communication devices with narrow borders.

Note that the above element sizes, element shapes, and frequency ranges are not limitations of the invention. An antenna designer can fine-tune these settings or values according to different requirements. It should be understood that the mobile device and the antenna structure of the invention are not limited to the configurations of FIGS. 1-3. The invention may merely include any one or more features of any one or more embodiments of FIGS. 1-3. In other words, not all of the features displayed in the figures should be implemented in the mobile device and the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A mobile device, comprising:

a metal back cover;

an edge appearance element, made of a nonconductive material, wherein the edge appearance element is connected to the metal back cover;

a display device, disposed opposite to the metal back cover;

a supporting element;

an antenna structure, disposed on the supporting element, wherein the antenna structure is positioned between the edge appearance element and the display device; and a ground element, coupled to the metal back cover;

wherein electromagnetic waves of the antenna structure are transmitted through the edge appearance element, such that the mobile device supports wireless communication;

wherein the antenna structure comprises:

a feeding radiation element, having a feeding point;

a connection element, coupled to the feeding radiation element;

a first radiation element, coupled to the connection element, and extending toward the ground element;

a shorting element, wherein the connection element is coupled through the shorting element to the ground element;

a second radiation element, coupled to the connection element and a third radiation element, coupled to the shorting element, wherein the second radiation element and the third radiation element extend in the same direction.

2. The mobile device as claimed in claim 1, wherein the metal back cover is a complete metal plane without any slot.

3. The mobile device as claimed in claim 1, wherein the ground element is a ground copper foil extending from the metal back cover onto the supporting element.

4. The mobile device as claimed in claim 1, wherein a distance between the supporting element and the display device is longer than 1 mm.

5. The mobile device as claimed in claim 1, wherein the antenna structure covers a first frequency band from 2400 MHz to 2500 MHz, and a second frequency band from 5150 MHz to 5850 MHz.

6. The mobile device as claimed in claim 1, wherein the shorting element further comprises a rectangular widening portion coupled to the ground element.

7. The mobile device as claimed in claim 1, wherein the antenna structure further comprises:

a fourth radiation element, coupled to the feeding radiation element, wherein the fourth radiation element and the second radiation element extend in opposite directions.

8. The mobile device as claimed in claim 1, further comprising:

a coaxial cable, comprising a central conductive line and a conductive housing, wherein the central conductive line is coupled to the feeding point, and the conductive housing is coupled to the ground element.

9. The mobile device as claimed in claim 8, wherein a length of the coaxial cable is shorter than 720 mm.

* * * * *